US008449133B2

(12) United States Patent
Winzer et al.

(10) Patent No.: US 8,449,133 B2
(45) Date of Patent: May 28, 2013

(54) VISIBILITY VEST

(76) Inventors: Kevin Winzer, Middletown, MD (US); Seth McBee, Middletown, MD (US); Kyle Crawford, Middletown, MD (US)

( * ) Notice: Subject to any disclaimer, the term of this patent is extended or adjusted under 35 U.S.C. 154(b) by 0 days.

(21) Appl. No.: 13/061,613

(22) PCT Filed: Sep. 2, 2009

(86) PCT No.: PCT/US2009/055762

§ 371 (c)(1),
(2), (4) Date: Sep. 22, 2011

(87) PCT Pub. No.: WO2010/028069

PCT Pub. Date: Mar. 11, 2010

(65) Prior Publication Data

US 2012/0002403 A1 Jan. 5, 2012

Related U.S. Application Data

(60) Provisional application No. 61/093,823, filed on Sep. 3, 2008, provisional application No. 61/179,425, filed on May 19, 2006, provisional application No. 61/219,956, filed on Jun. 24, 2009.

(51) Int. Cl.
*F21V 33/00* (2006.01)

(52) U.S. Cl.
USPC ..... 362/108

(58) Field of Classification Search
USPC ..... 362/108
See application file for complete search history.

(56) References Cited

U.S. PATENT DOCUMENTS

| | | | | |
|---|---|---|---|---|
| 3,153,745 | A * | 10/1964 | Gurian et al. | 315/206 |
| 5,070,436 | A * | 12/1991 | Alexander et al. | 362/108 |
| 5,779,348 | A * | 7/1998 | Interlicchio | 362/108 |
| 5,984,488 | A * | 11/1999 | Tung | 362/108 |
| 6,267,482 | B1 * | 7/2001 | Miller et al. | 362/103 |
| 6,517,214 | B1 * | 2/2003 | Mitchell et al. | 362/108 |
| 6,769,138 | B2 * | 8/2004 | Golle et al. | 2/102 |
| 2008/0043458 | A1 * | 2/2008 | Desjardin | 362/108 |

FOREIGN PATENT DOCUMENTS

EP 1597980 11/2005

OTHER PUBLICATIONS

Search Report for PCT/US2009/055762 dated May 10, 2010 (3 pages).

* cited by examiner

*Primary Examiner* — Laura Tso
(74) *Attorney, Agent, or Firm* — Baker Donelson Bearman Caldwell & Berkowitz, PC

(57) ABSTRACT

The present application is directed to a method for providing reflective and/or lighted capability about the torso of a wearer, said method comprising providing it least one reflective and/or lighted strap, draping said strap about said torso, adjusting said strap via a mechanism that keeps said strap relatively taut about torso such that when said wearer is engaged in movement, said straps remain in place on said torso without substantial impediment to said wearer engaging in an activity.

5 Claims, 6 Drawing Sheets

VISIBILITY VEST

CROSS REFERENCE TO RELATED APPLICATIONS

This application is related to Provisional Applications 61/093,823 filed Sep. 3, 2008, 61/179,425 filed May 19, 2009, and 61/219,956 filed Jun. 24, 2009. This application is a 371 of PCT/US2009/055762 filed Sep. 2, 2009. Each application, including the specifications on all figures are incorporated herein by reference in their entireties.

BACKGROUND OF THE INVENTION

1. Field of the Invention

This application relates generally to the field of safety apparel, and in particular to novel and nonobvious products and methods of use the vests and vest-type garments.

2. Description of Related Art

While the prior art has disclosed many different types of garments, nothings fulfills the needs of a lightweight, aerodynamic product with the unique designated tightening mechanism for adjustability with or without lighting associated therewith.

SUMMARY OF THE INVENTION

The present invention is directed to several embodiments that are depicted in the attached drawings as well as in the description.

DETAILED DESCRIPTION OF A PREFERRED EMBODIMENT

Figure 1:
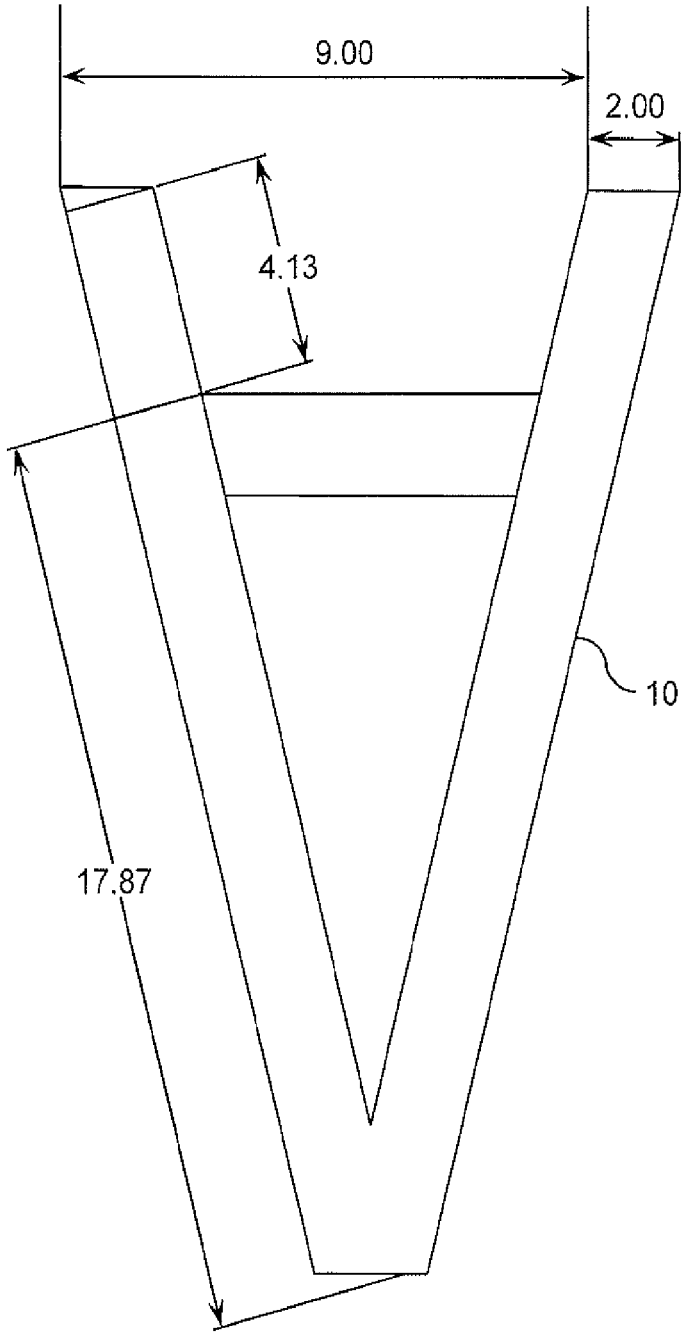
FIG. 1 illustrates the front side of the visibility vest showing the structure material for support including reflective materials of the present invention.
Figure 2:
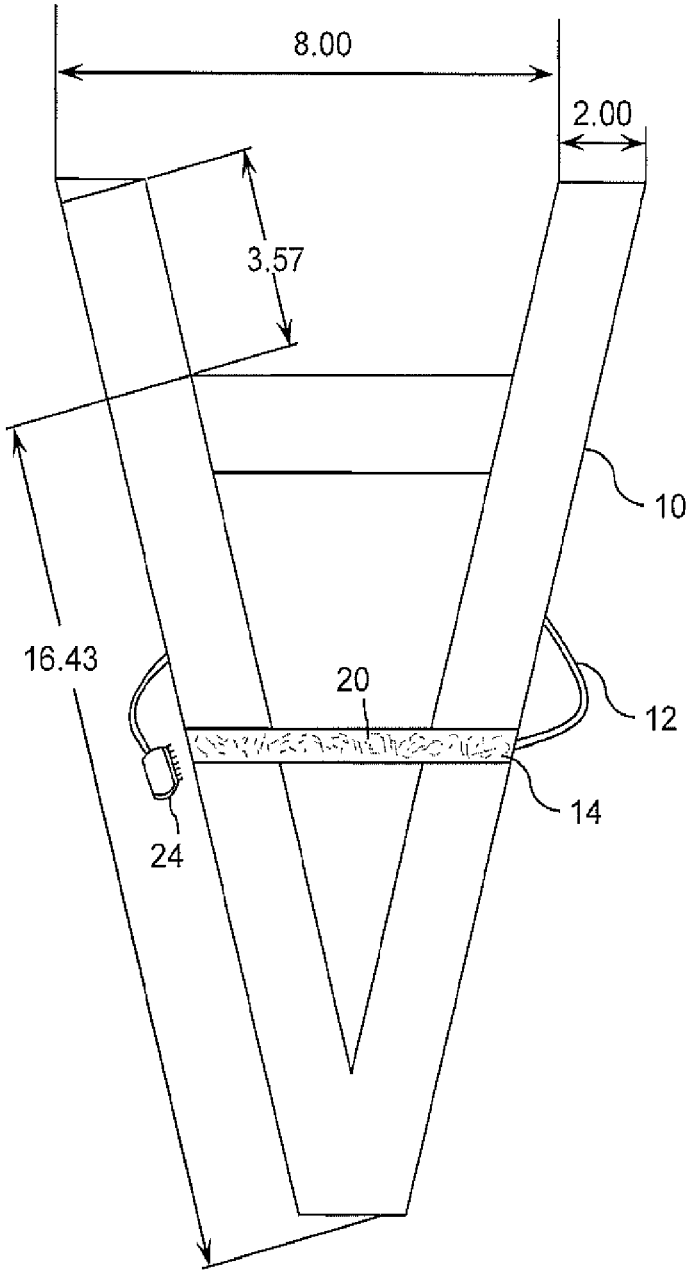
FIG. 2 illustrates the front side of the visibility vest showing an elastic tightening mechanism including Velcro for adjustability of size of the present invention.
Figure 3:
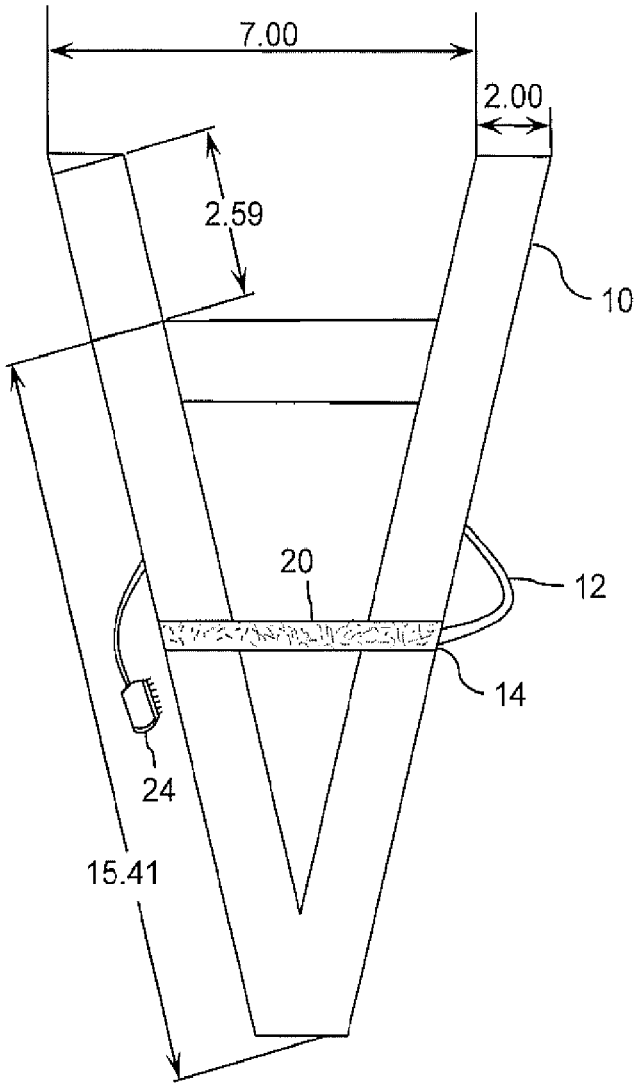
FIG. 3 illustrates the front side of the visibility vest showing an alternative advantageous dimension of the present invention.
Figure 4:
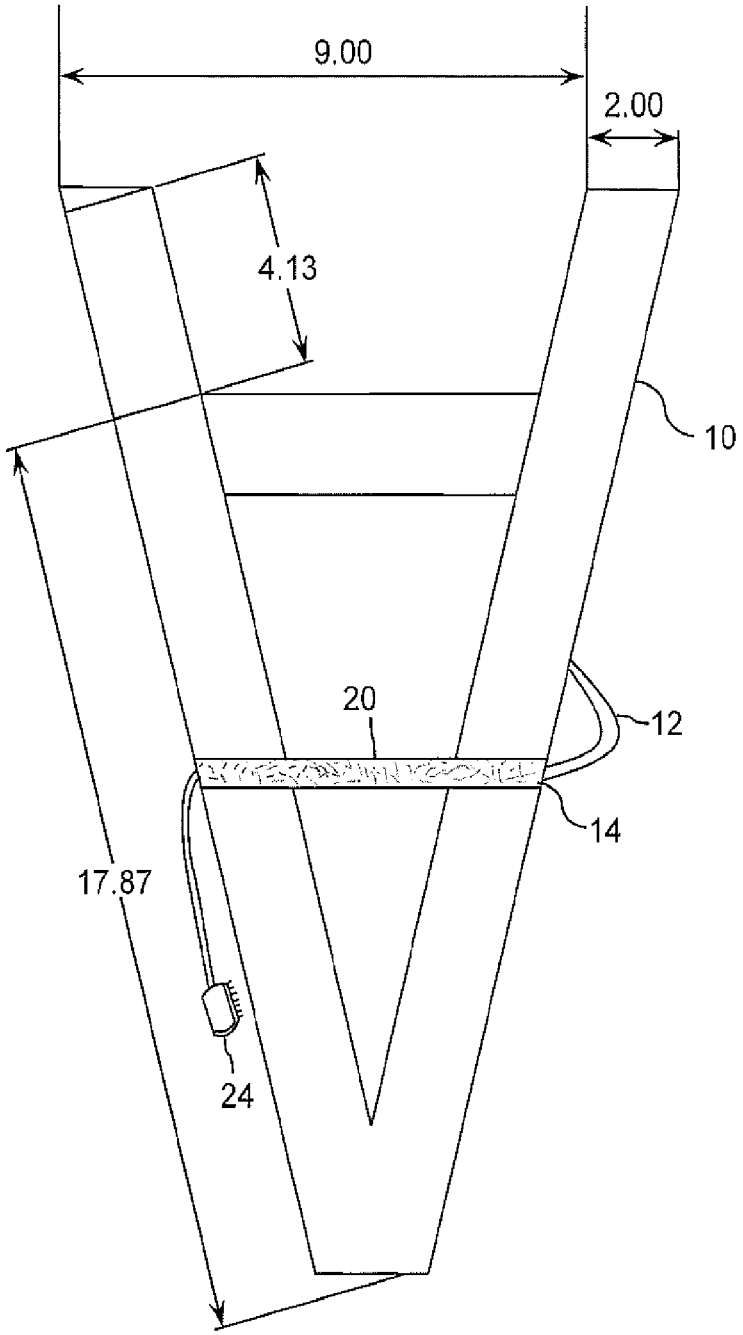
FIG. 4 illustrates the front side of the visibility vest showing yet another advantageous and alternative dimension of the present invention.
Figure 5:
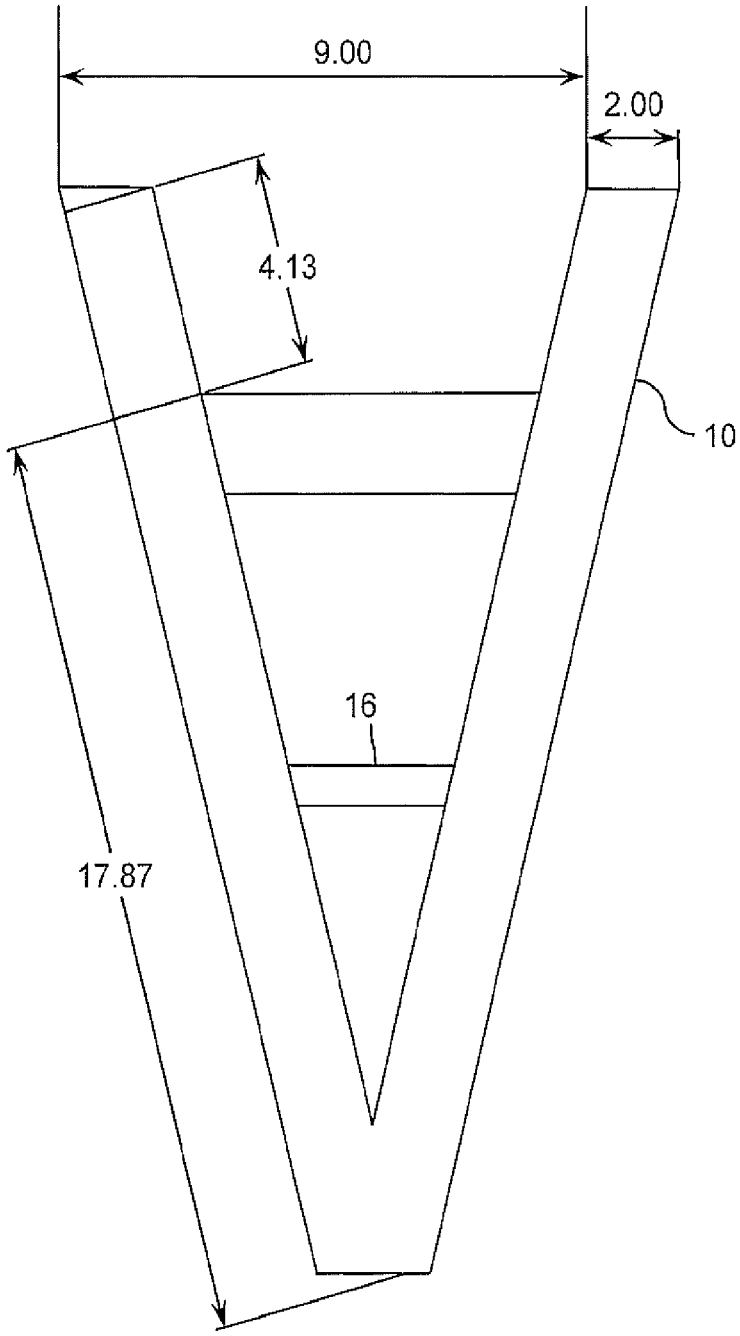
FIG. 5 illustrates the interior of the front side of the present invention.
Figure 6:
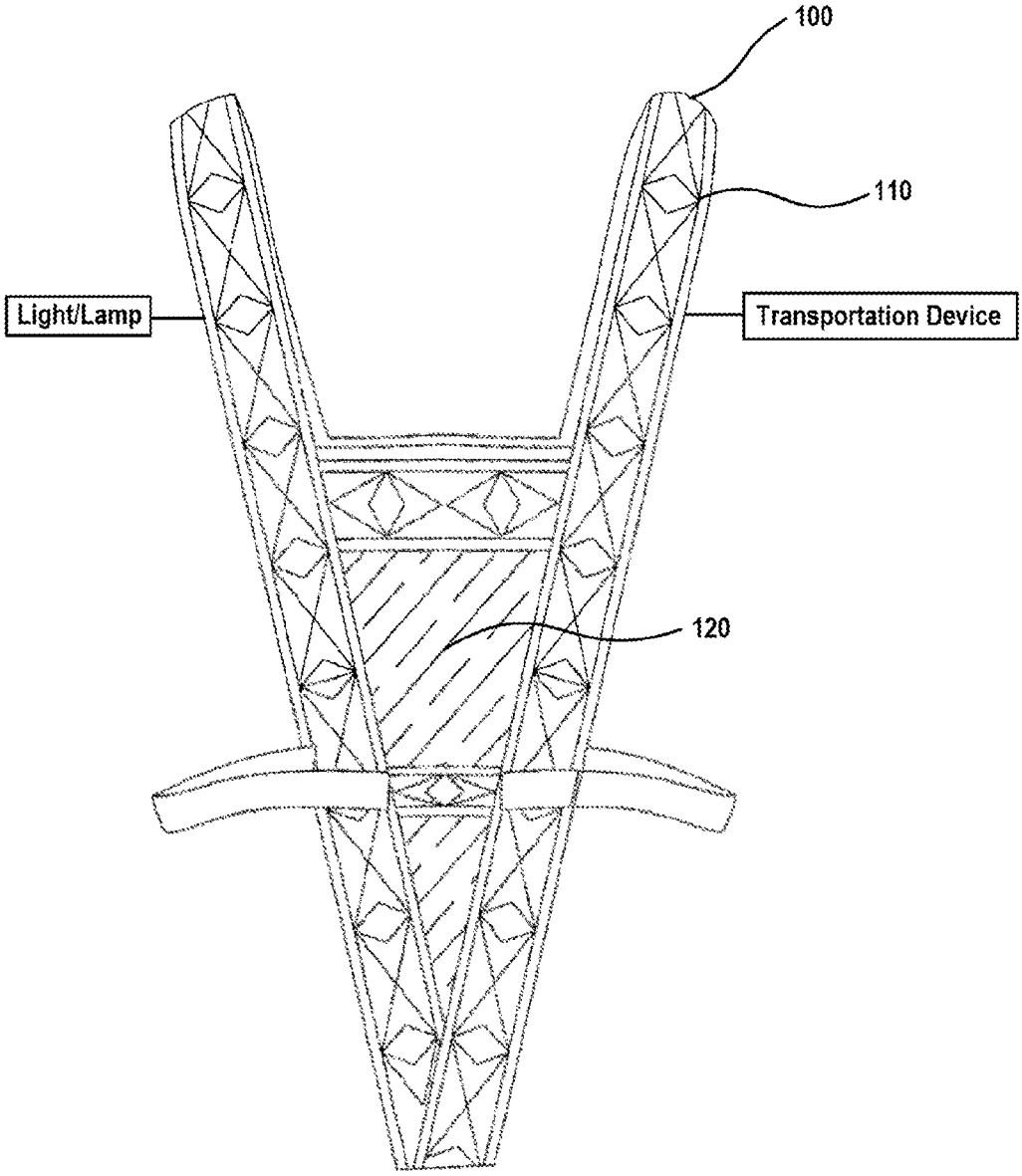
FIG. 6 illustrates the front side of the visibility vest with reflective materials including a light source and showing the linking capability to a transportation device of the present invention.

FIGS. 1-6 depict various embodiments of the present invention. In connection with the present invention, preferably there is provided a set of straps with a central section that can enclose identification information, any other important small item, and/or a document and/or a logo and/or a design. For example, this is shown in FIG. 6, wherein in a central portion thereof, there is provided the logo, —Middletown Knights—. This central area can be merely a logo only screenprinted or sewn thereon, for example, and/or it could comprise an information pouch. The central area as well as all other fabrics other than the reflective portions of the vest can be any suitable material, but particularly a single ply, lightweight material (i.e. preferably not more than 6 oz/sq. yard), such as a technical performance material used in running shirts. These lightweight technical material such as CLIMACOOL fabrocs made by UNDERARMOUR and the like provide wicking of sweat and do not impart a lot of weight to the vest itself. An information pouch can be very critical for identifying people working in secure areas such as in airports, military bases, etc. It is also possible to include basic ID information in the event the vest is used by children, runners, dogs, bicyclists, motorcyclists, hunters, kayakers, construction personnel. airport personnel, and scooter riders. The central fabric is advantageously a triangle in shape. The central portion can be any size, color, and material and can be adapted as desired to include specific colors based on decals for schools/businesses, based on colors that are more luminescent such as orange, pink, lime green, digital army camo (military case) etc.

A vest of the present invention is preferably light in weight and is preferably less than 18 oz., more preferably less than 17, 16, 15, 14, 13, 12, 11, 10, 9, 8, 7, 6, 5, 4, or even 3 oz. or even 2 oz in overall weight. In other embodiments, the vest can be adapted to include weights in the event the wearer wishes to increase the resistance imparted when partaking in exercise activities or the like. The weights can be any amount, for example, a 0.5-5 lb (or more or less as desired) weight can be provided in a pouch provided on the front of the vest and also a corresponding 0.5-5 lb weight can also be provided in a pouch in the rear section of the vest.

Some advantageous dimensions for the vest are shown on FIGS. 1-6. For example, the widest portion of the vest can advantageously range from about 7-9 inches at its widest portion. The length of the straps in the front portion can advantageously range from 18-22 inches. The reflective material is advantageously 2 inches in width.

In some embodiments, there can optionally be provided a light source such as LEDs (light emitting diodes), which can also connect to a motor vehicle's lighting s\stem (or not). The light source can be programmed to produce light NA hen the operator puts on brakes or turn signals. A batters pack can also be used to produce portable, "emergency-like" flashing or non-flashing lights. The light source of the present invention is better adapted than many current bicycle lights in that a larger area of lights on the torso and/or shoulders of the rider, closer to the height of a person's eyes is displayed. This safer/more visible compared to just a single light source on the bike itself. This means that drivers can see and recognize the entire size/shape of the bike/rider and this will minimize accidents and the likelihood of being distracted by just a single light, which is unclear what is actually there.

A vest of the present invention preferably includes luminescent fabric or material of the vest 10. Any portion of the vest 10 can be provided with luminescent material. In a preferred embodiment, at least 25% of the vest includes luminescent: material, and in some cases at least 50%, in other cases, at least 75% and even at least 80% or even 85%. The lighted embodiment can either be powered by plugging into an 'adaptor of a motorize vehicle or powered in any desired way. One possibility is to power the vest 10 by use of a battery, preferably any type of lightweight or easy to use battery or power source such as a 9-volt battery or else any type of rechargeable battery or disposable battery (not shown) as desired. A battery or power source can be housed in a package attached to the vest and can be wired in a way that a switch can be used to activate the lights.

Accessories can be optionally attached to the vest 10 for personal preference. The vest can include a backpack-like sack attachment to carry personal items or identification information. Fabric loops (not shown) can be attached anywhere on the vest 10 to carry items such as flashlights, knifes, etc. On the bottom of the front and back halves of the vest, an insert can be attached to allow for weighted material, such as sandbags, etc, can be used to allow for weighted training for any athlete or user.

The vest 10 preferably utilizes an elastic "belt" 12 that can be adjusted for comfort. One end of the elastic 12 can be adhered to a reverse side of a front half of the vest 14 and adapted to wrap around the vest 10 where it enters a piece of fabric 16 on the reverse side of the hack half 22 of the vest 10. The elastic 12 continues to wrap around to a front portion of the vest 18 where it can be adjusted by VELCRO 20 adhered to one side of the elastic 12 and connecting to a strip of VELCRO 20 on the front half of the front of the vest. This is shown the figures. The elastic belt 12 can also be attached by having two pieces of Velcro 20 on the ends of the belt and wrapping around in a similar fashion and moved along the VELCRO strip for comfort. The elastic 12 that is fused to the VELCRO 20, either by sewing or by any other desired mechanism such as by use of an adhesive material, can include a reflective material 24 (also sewn or adhered in any way desired.). This increases the amount of the reflective material on the middle half of a front end 18 of the vest 10. Reflective material 24 can also be attached in any manner along the elastic to increase the visibility in any portion of the 360-degrees encircling the wearer.

Garments of the present invention are preferably adapted to meet safety regulation in various countries including the regulations of Class I and Class II of United States. The requirements for Class I and Class II are incorporated herein by reference in their entities. In yet another embodiment, there can be reflective material on the sides of the elastic strap 12. In this case, the reflective material can cover any percentage of the elastic strap, such as up to 100% or up to 85% of the surface area. In some preferred embodiments approximately 50% of the outer surface area of the elastic strap is reflective.

In yet a further embodiment there is provided a wireless transmitting/receiving device (not shown) from the vehicle (and/or transportation device such as its electrical system, to the vest 10. Such a device could be adapted to send a signal to the vest 10 from the vehicle (not shown) activating predetermined LEDs or other lighting devices to emit corresponding to the bike's brakes, and/or signals. In some embodiments, the wireless transmitting/receiving device could be otherwise coupled to the bike so that lithe bike slowed below a certain speed, the lights would emit in a Hashing .pattern or other predetermined way without intervention by the user. This pro\ides yet further safety aspects. The light(s) could also be adapted to illuminate in certain predetermined ways upon the vehicle or wearer accelerating/decelerating at a particular rate, for example.

What is claimed is:

1. An illuminated and reflective vest to be worn on a user comprising:

Two v-shaped portions, each v-shaped portion including two reflective strap sections each section having a first end located at approximately the shoulder of said user, extend across the body and have second ends which meet at central apex point, One v-shaped portion extends along the front of the user and the other v-shaped portion extends along the back of the user, A belt which extends around the torso of the user and is adapted to hold the reflective v- shaped portions against the user, the bottom of the v-shaped portion extends below the belt, Two horizontal portion, each extending above and parallel to the belt and connecting two strap sections of each of the v-shaped portions, and Wherein the two v-shaped portions and the horizontal portions are at least 25% reflective and contain lighted or luminescent elements.

2. A vest of claim 1, wherein said belt is elastic.

3. A vest of claim 2, wherein at least said central portion comprises a technical performance material.

4. A vest of claim 1 further comprising at least one light, wherein said light comprises LED lights.

5. The illuminated and reflective vest of claim 1, further including a central portion adapted to receive an indicia.

* * * * *